United States Patent [19]

McMillan et al.

[11] 4,160,546

[45] Jul. 10, 1979

[54] DOCUMENT OVERLAP-DETECTING APPARATUS AND PROCESS

[75] Inventors: Andrew H. McMillan, Wayne; Daniel A. Wisner, Milan, both of Mich.

[73] Assignee: Burroughs Corporation, Detroit, Mich.

[21] Appl. No.: 873,082

[22] Filed: Dec. 23, 1977

[51] Int. Cl.[2] ..... B65H 7/12

[52] U.S. Cl. ..... 271/263

[58] Field of Search ..... 271/263, 265, 259, 261, 271/262

[56] References Cited

U.S. PATENT DOCUMENTS

| | | | |
|---|---|---|---|
| 3,026,419 | 3/1962 | Aweida | 271/263 X |
| 3,186,708 | 6/1965 | Hinz | 271/259 |
| 3,578,315 | 5/1971 | Milford | 271/263 |
| 3,778,051 | 12/1973 | Allen | 271/262 |

*Primary Examiner*—Richard A. Schacher

*Attorney, Agent, or Firm*—Carl Fissell, Jr.; Robert L. Kaner; Kevin R. Peterson

[57] ABSTRACT

An apparatus and process for detecting overlapped documents in a document processing apparatus by detecting the translucency of the documents. The disclosed apparatus includes a transport path for guiding documents and drive wheels for moving the documents along the transport path. Four LED (light source) phototransistor (light detector) pairs are located across the transport path. One LED-phototransistor pair is used together with electronics to detect when a document is present. Two LED-phototransistor pairs are used together with edge detection electronics to detect sudden significant changes in document translucency from the immediately previous translucency of the same document as the documents pass thereby. The other LED phototransistor pair is used together with level detect electronics to sample and hold the translucency level at the beginning of each document, and then to detect when the present translucency level of the document exceeds predetermined guardbands on either side of the translucency level at the beginning of the document as the documents pass thereby. Overlap indicating electronics indicates overlapped documents when the outputs of the two edge detects and the level detect are continuously coincident for 1 millisecond, and then the output of the level detect remains continuously present for an additional 5.6 milliseconds.

21 Claims, 12 Drawing Figures

DOCUMENT OVERLAP-DETECTING APPARATUS AND PROCESS

CROSS REFERENCE TO OTHER APPLICATION

Cross reference is made to a patent application entitled "Document Processing, Jam Detecting Apparatus and Process", of McMillan and Templeton, U.S. Ser. No. 856,848, filed on Dec. 2, 1977 which is assigned to common assignee. Such application discloses a document processing apparatus that detects jammed documents by sensing when the translucency of a document is generally unchanged for a period of time.

BACKGROUND OF THE INVENTION

1. Field of the Invention

This invention relates in general to document processing systems; and more particularly to overlapped document detectors in such systems.

2. Description of the Prior Art

Document processing machines often serially process documents from a stack of documents. Generally, a mechanical feeder mechanism is used to serially feed documents into a document transport path at predetermined intervals. For various reasons, such feeder mechanisms can accidentally feed two documents such that they physically overlap to some extent rather than being serial. It is, of course, desirable to detect such overlapped documents when they occur because generally the machine will not be able to process them properly. Once the overlapped documents are detected, the machine can be automatically stopped, or the machine can continue to process documents with the overlapped documents being automatically processed into a reject pocket. Generally, document overlap detectors are located immediately after the mechanical feeder such that overlapped documents can be detected before other document processing functions are performed.

Document processing machines can process various types of documents such as, for example, bank checks. Thus, documents can have various sizes, various thicknesses and other irregularities such as lines, printing or pictures thereon or punched holes therein.

One technique that has been used for detecting overlapped documents utilizes vacuum principles. Vacuum pressure from ports located on either side of the transport path pull overlapped documents apart and then the individual documents can be detected. One such system senses changes in vacuum pressure when the separated documents cover the vacuum ports on either side of the transport path. Such a system, however, requires an expensive and noisy vacuum pump together with cumbersome fluid plumbing. Also, such a system will not work on documents that are stapled or otherwise firmlyfastened together.

Another technique for detecting overlapped documents utilizes positive air pressure principles. Positive air pressure is blown on the documents in an attempt to separate the documents and press them against opposite sides of the transport path. Light sources and sensors (in pairs on the same side of the transport path) on both sides of the transport path detect light reflected from the documents when they are against the sides of the transport path. This technique also involves a pump and fluid plumbing. Also, it will not work on documents that are stapled or otherwise firmly fastened together.

U.S. Pat. No. 3,778,051, issued to Allen et al, describes a mechanical transducer that physically contacts documents for detecting and indicating when the thickness of successive documents differs from the thickness of a first document. Such a system, however, must physically contact the document and operates only on a sequence of documents having the same expected thickness.

U.S. Pat. No. 3,186,708, issued to Hinz, describes a document overlap detecting device that utilizes light reflected from the leading (or trailing) thickness edge of an overlapped document. The device provides two of these thickness edge detectors and requires coincidence to indicate an overlapped document. Such a scheme, however, does not detect the translucency of documents. Also, the edges of typical documents might not be predictable enough to reliably reflect the light as desired. Also, such a detector could be fooled by creases or other irregularities in a document's surface.

U.S. Pat. No. 3,026,419, issued to Aweida et al, describes a document overlap detecting device that utilizes a single sensor to detect the translucency of a document. The single sensor is used to detect sudden changes in document translucency and thus indicate overlapped documents. However, such a device could be falsely triggered by marks on or holes in documents.

U.S. Pat. No. 3,578,315, issued to Milford, describes a document overlapped detecting device that utilizes two document present sensors and a third sensor that detects diffused (refracted) light that passes through translucent portions of the document. The device requires coincidence between the two document present sensors and the diffused light sensor. At the beginning of each batch of documents, an automatic gain control amplifier on the output of each sensor is adjusted for that batch of documents. Thus, this device appears to operate on documents that are similar within a batch. Also, this device could be falsely triggered by marks on documents.

SUMMARY OF THE INVENTION

The present invention provides an overlapped document detector that operates on various types of intermixed, undefined documents. It is fast, reliable and does not interfere with normal document movement.

An overlap detector according to the present invention detects the translucency of a document. It utilizes at least one edge detector to detect sudden changes in document translucency from the immediately previous translucency. It also utilizes a level detector to detect when the present translucency level of a document differs by at least a given amount from the translucency level at a time prior to the sudden change in translucency. The overlap detector requires coincidence between the output indications of the edge detector and the level detector, and also requires the output indication of the level detector to exist for a given time before it will indicate overlapped documents.

The present invention provides an overlapped document detector that automatically works well with various types of documents that are randomly intermixed and have various sizes, thicknesses and other irregularities. For example, document processing machines often process bank type checks. Such checks have various lengths and widths from document to document. Checks may differ in thickness from thin paper to cardboard like material from document to document. Checks also often have other irregularities such as printing thereon, pictures thereon and even holes therein such as appear in punched cards. Thus, an overlapped document detector in a check processing apparatus must be capable of operating with a virtually undefined document.

The preferred embodiment of the present invention utilizes four light source-light detector pairs that are arranged to form a straight vertical column along the document transport path. Two sensor pairs are used to provide two edge detectors that indicate sudden significant changes in document translucency as the document passes thereby. Another sensor pair is used to provide a level detector that indicates when the present document translucency level differs from the translucency level at the beginning of the same document by at least a given amount. The fourth sensor pair is used to provide a document present detector that indicates the presence or absence of a document. Briefly, an overlapped document is indicated when a document is present and the outputs of the two edge detectors and the level detector are coincident, plus the output of the level detector must continually exist for at least one-half inch of document travel past the detection apparatus.

The two edge detectors in the preferred embodiment each indicate sudden significant changes in document translucency as the leading or trailing edge of a document overlap passes thereby. They continually monitor the present translucency of the document and indicate when the present translucency has suddenly changed in either direction (darker or lighter) by a given amount from the translucency immediately prior to the sudden change. The edge detectors are effective because it is believed that when documents overlap, the effective change in translucency is greater than one might expect by simply adding the translucencies of the individual documents; thus, the edge detector is effective even when a relatively thin document overlaps a relatively thick document. The edge detectors, however, can be triggered by borders or other vertical lines or marks on a document or holes therein, which characteristics can result in sudden significant changes in translucency.

The level detector in the preferred embodiment samples and holds the translucency level during approximately the first 0.2 inch (0.5 cm) of document travel past its sensor pair. Thereafter, the level detector for the remainder of the document compares the present translucency level to the translucency level at the beginning of that document and indicates when the present translucency level differs in either direction (darker or lighter) by at least a predetermined amount from that at the beginning of the document. Again, the level detector is effective because it is believed that when documents overlap, the effective change in translucency is greater than one might expect by simply adding the translucencies of the individual documents.

The indicating logic in the preferred embodiment first requires the coincidence of either three dark signals (two edge detector's dark plus the level detector dark) or three light signals (two edge detectors light plus the level detector light). The indicating logic then further requires the level detector output signal (either a dark or light) to remain continuously present for a predetermined period of time corresponding to approximately one-half inch of document travel. Thus, the preferred embodiment requires coincident, sudden, significant changes in document translucency indicating that the sudden changes correspond to a vertical edge; and it further requires that a guardband level of translucency for that particular document be exceeded continuously for at least one-half inch of the document travel before it indicates an overlapped (double) document.

DETAILED DESCRIPTION OF THE INVENTION

Figure 1:
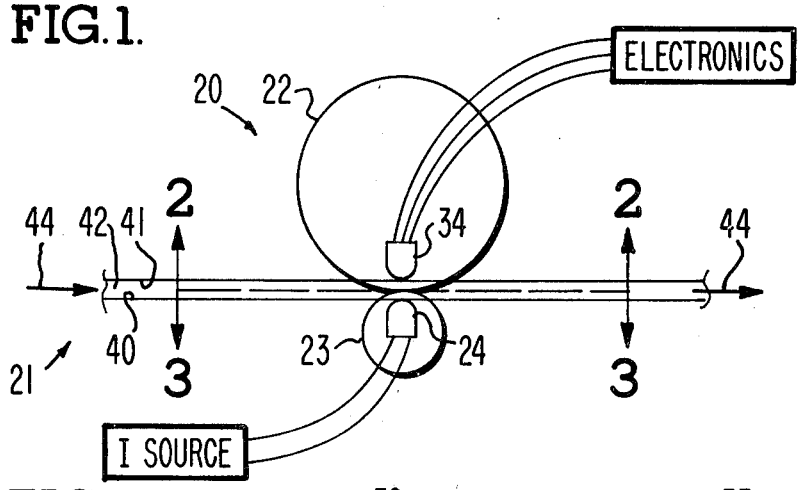
FIG. 1 is a top view of an overlapped document detecting apparatus according to the present invention.
Figure 2:
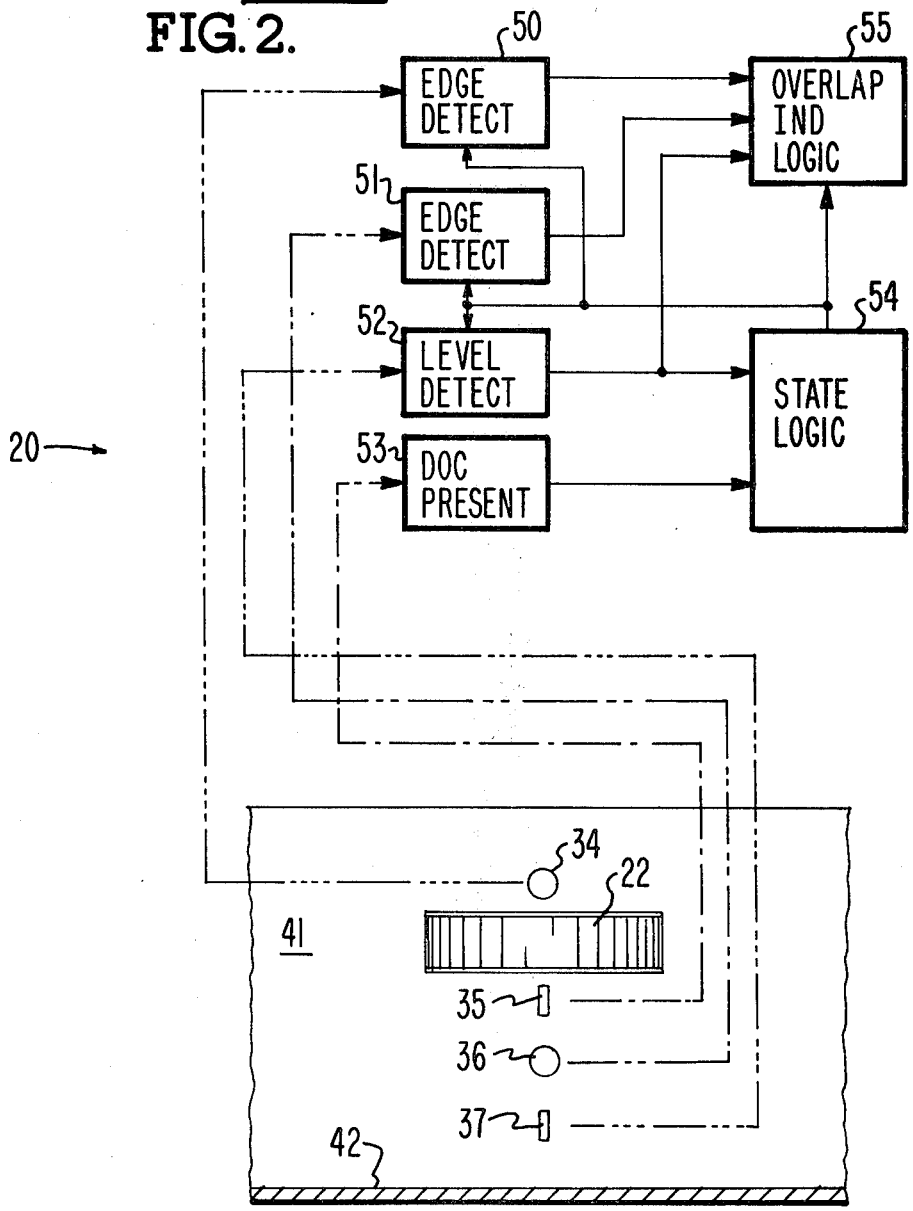
FIG. 2 shows a front sectional view taken along the line 2—2 of FIG. 1.
Figure 3:
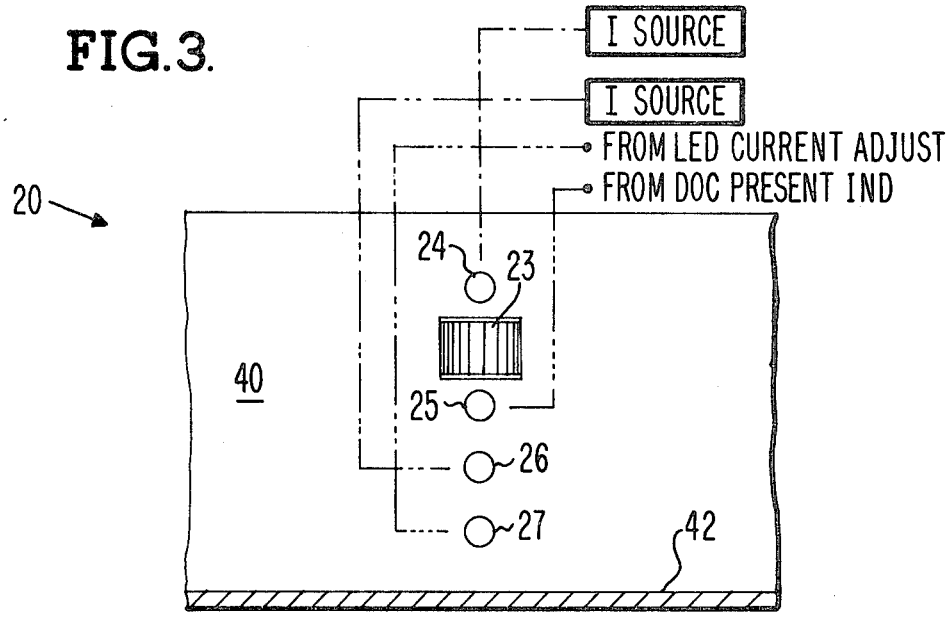
FIG. 3 shows a rear sectional view taken along the line 3—3 of FIG. 1.

An apparatus 20 that detects overlapped documents in a moving document system according to the present invention is shown in top view in FIG. 1 and in front and rear sectional views, respectively, in FIGS. 2 and 3. A moving document system may, for example, process bank checks, detect magnetic and/or optical characters thereon, and appropriately sort such checks. The apparatus 20 includes a transport path 21, a set of drive rollers 22 and 23, a plurality of light sources 24 through 27, a plurality of light detectors 34 through 37 and electronics, which electronics indicates when overlapped documents are detected.

The transport path 21 is formed by a pair of generally opposed walls 40 and 41 that are connected by a bottom wall 42, which bottom wall is generally perpendicular to the walls 40 and 41. The transport path guides the documents as they pass serially through the apparatus in the direction of the arrows 44.

The documents are driven along the transport path 21 by sets of drive rollers located at regular or irregular intervals. Each set of drive rollers includes a drive wheel 22, rotated by a motor via pulleys and drive belts located under the surface of the apparatus, and an idle roller 23 which is spring loaded against the drive wheel 22. The drive wheel-idle roller sets may, for example, drive documents down the transport path at a velocity of 75 inches per second (190 cm per second). The drive wheel-idle roller sets form a means for moving the documents along the transport path.

As the documents pass through the apparatus, they pass between the light sources 24 through 27 and the light detectors 34 through 37. The light source-light detector pairs 24 and 34, 25 and 35, 26 and 36, and 27 and 37 are located on opposite sides of the transport path and in line with each other. The light sources and light detectors are preferably mounted flush with or slightly recessed from their respective walls 40 and 41. The light sources and light detectors are located at one of the drive wheel-idle roller sets because this insures an accurate placement of the document within the width of the transport path thus virtually eliminating any translucency changes along a document's length caused by the document moving from side to side within the transport path. In addition, the placement of the light sources and light detectors at one of the drive wheel-idle roller sets minimizes document speed variations because speed variations could affect the output of the edge detect circuits. The light source-light detector pairs 24 and 34, and 26 and 36 are utilized to provide edge detection. The light source-light detector pair 27 and 37 is utilized to provide level detection; and the light source-light detector pair 25 and 35 is utilized to indicate when a document is present.

The light sources 24 through 27 may be provided by light emitting diodes (LEDs) such as Spectronics SE-5455. As further discussed later, current sources may be connected to and supply current to the LEDs to supply the desired illumination. The LEDs provide primarily infrared radiation which is believed to be more sensitive to changes in the thickness of documents, and less sensitive to the color of or marks on documents which occur more at random. Such infrared radiation will more easily pass through thick and darkly colored documents than visible radiation can. Of course, it is possible that other frequencies of light could be used in the present invention. Thus, it is intended that the term light may include visible, infrared and other frequencies of electromagnetic radiation. The light sources 24 through 27 and their associated current drive circuitry provide means located adjacent one surface of the document for illuminating a portion of the document.

The light detectors 34 through 37 may be provided by light sensitive phototransistors such as Spectronics SD-5443.

The light detectors 34 and 36 are used in edge detection and may be 0.140 inch in diameter. The dimension of the light detectors 34 and 36 is not crucial; however, a larger detector would in effect dilute the sudden changes, and a smaller detector would in effect make them more susceptible to narrow lines and marks on a document. The light detectors 34 and 36 respectively provide electrical signals to edge detects 50 and 51. The edge detects monitor the phototransistor output (the translucency of the document) and provide output indications when the translucency of the document suddenly changes by a significant amount from the immediately previous translucency of that same document. Such sudden, significant changes in translucency, however, could also be caused by marks or lines on the document, changes in the document's thickness or fibers, or holes in the document. The edge detects not only indicate a sudden, significant change in translucency, but also they indicate whether the change represents a dark edge (less translucency) or a light edge (more translucency). Further explanation of the edge detects will follow later.

The light detector 37 is used in level detection and may be masked such that it is 0.02 inch wide and 0.140 inch high. The level detect light detector 37 is located near the bottom of the transport path where it will detect changes in light as the magnetic characters on the bottom of the check (such as bank number, account number and amount) pass thereby. These magnetic characters have a required minimum space therebetween of approximately 0.02 inch which corresponds to the width of the mask over detector 37. The detector 37 provides electrical signals to a level detect 52. The level detect 52 samples and holds the translucency level at the beginning of each document, places guardband threshold levels around the beginning translucency level, and provides output indications when the threshold levels are exceeded. Such output indications occur during the sensing of overlapped documents. However, such output indications could also be caused by changes in document thickness, marks or colors on the document, and holes therein; and such output indications could be caused by gradual changes in detected document translucency over the length of the document. The level detect not only indicates when the guardbands have been exceeded, but also indicates whether they were exceeded by a dark level (less translucency) or a light level (more translucency). Further explanation of the level detect will follow later.

The light detector 35 is used in the document present indicator and may be masked such that it is 0.05 inch wide and 0.140 inch high. The dimensions of the light detector 35 are not crucial; however, it is masked so that it will provide a sharp transition document present signal. The detector 35 provides electrical signals to a document present indicator 53. The indicator 53 provides an output indication when a document is present between source 25 and detector 35. This output is utilized by the state logic 54.

The state logic 54 provides four separate states in response to signals from the document present indicator 53 and the level detect 52. The state logic in turn supplies control signals to the edge detects 50 and 51, the level detect 52 and the overlap indicating logic 55. The state logic will be more thoroughly described later with respect to FIGS. 5 and 6.

The overlap indicating logic 55 analyzes the outputs of the edge detects 50 and 51 and the level detect 52 during state 3 and appropriately indicates when overlapped documents are detected.

Figure 4:
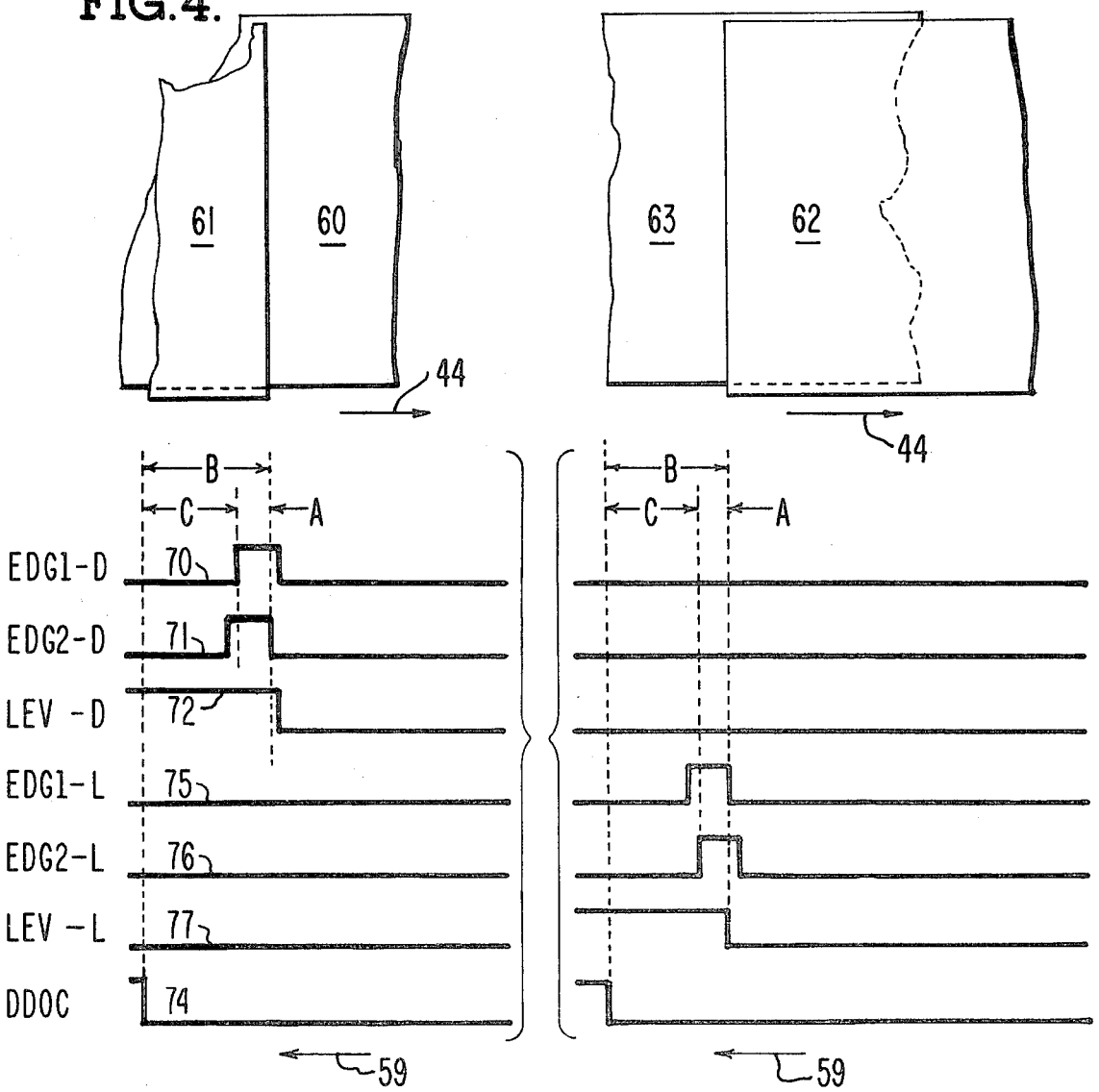
FIG. 4 shows overlapped documents and signal waveforms, and describes the general operation of the apparatus shown in FIGS. 1, 2 and 3.

Referring more particularly to FIG. 4, shown on the left is a first document 60 that is overlapped by a second document 61. The documents 60 and 61 pass by the sensors in the direction of the arrow 44 (left to right) and in response thereto the circuitry provides the waveforms indicated below. It should be noted that the time scale of the waveforms as indicated by the arrow 59 increases in time from right to left such that the timing of the waveforms corresponds to the effective movement of the documents. As the documents 60 and 61 pass by the sensors, while moving in the direction of the arrow 44, each of the edge detects 50 and 51 outputs an edge dark pulse signal (70 and 71) when it detects the corresponding sudden, significant decrease in translucency; and the level detect 52 outputs a level dark signal (72) when it detects an appropriate decrease in translucency compared to the translucency at the beginning of the document 60. The overlap indicating logic 55 first requires all three signals to be continuously coincident for a time A. The time A may, for example, be one millisecond and corresponds to a document travel distance of 0.075 inch at 75 inches per second. The overlap indicating logic 55 then requires the level dark signal 72 to be continuously present for an additional time C. The time C may, for example, be 5.6 milliseconds such that the total time B is 6.6 milliseconds which corresponds to 0.5 inch of document travel at 75 inches per second. When both requirements have been met, then overlap indicating logic 55 provides a Double Document signal (DDOC) 74. Thus, the edge detects indicate at 70 and 71 a sudden, significant decrease in translucency compared to the immediately previous translucency; and the level detect indicates at 72 that the level of translucency has decreased compared to the level of translucency at the beginning of the document. The overlap indicating logic 55 requires all three of these translucency decrease signals (70, 71 and 72) to be coincident for a time A and the level decrease signal (72) to indicate a decreased level for the time B before it will indicate a double document 74. Thus, while the edge detects alone could be fooled by vertical lines or other marks on a document or holes therein, the level detect and overlap logic minimizes any problems by requiring the change in translucency to remain for one half inch of document travel. Also, while a level detect alone could be fooled by gradual changes in a document translucency over the length of a document such as by color changes, the edge detects and the overlap logic minimize any problems by requiring a sudden, significant change in translucency. Thus, by requiring coincidence between the edge detects and the level detects, as well as by requiring the level detect to exist for one-half inch of document travel, the present invention provides a document overlap detector that works on various kinds of intermixed, undefined documents and is fast and reliable.

Shown on the right in FIG. 4 are overlapped documents 62 and 63 with document 62 ending its overlap. Again, the documents move past the sensors in the direction of the arrow 44 (left to right) and the time scale of the waveforms as indicated by the arrow 59 increases in time from right to left. As the documents 62 and 63 pass by the sensors while moving in the direction of the arrow 44, each of the edge detects 50 and 51 outputs an edge light pulse signal (75 and 76) when it detects the corresponding sudden, significant increase in translucency; and the level detect 52 outputs a level light signal (77) when it detects an appropriate increase in translucency compared to the translucency at the beginning of the overlapped documents 62 and 63 assuming the leading edges of documents 62 and 63 were aligned when they passed the sensor. The overlap indicating logic 55 first requires all three signals (75, 76 and 77) to be coincident for a time A. Then, the overlap indicating logic 55 requires the level light signal 77 to be continuously present for an additional time C to provide the time B before it will indicate a double document 74.

Figure 5:
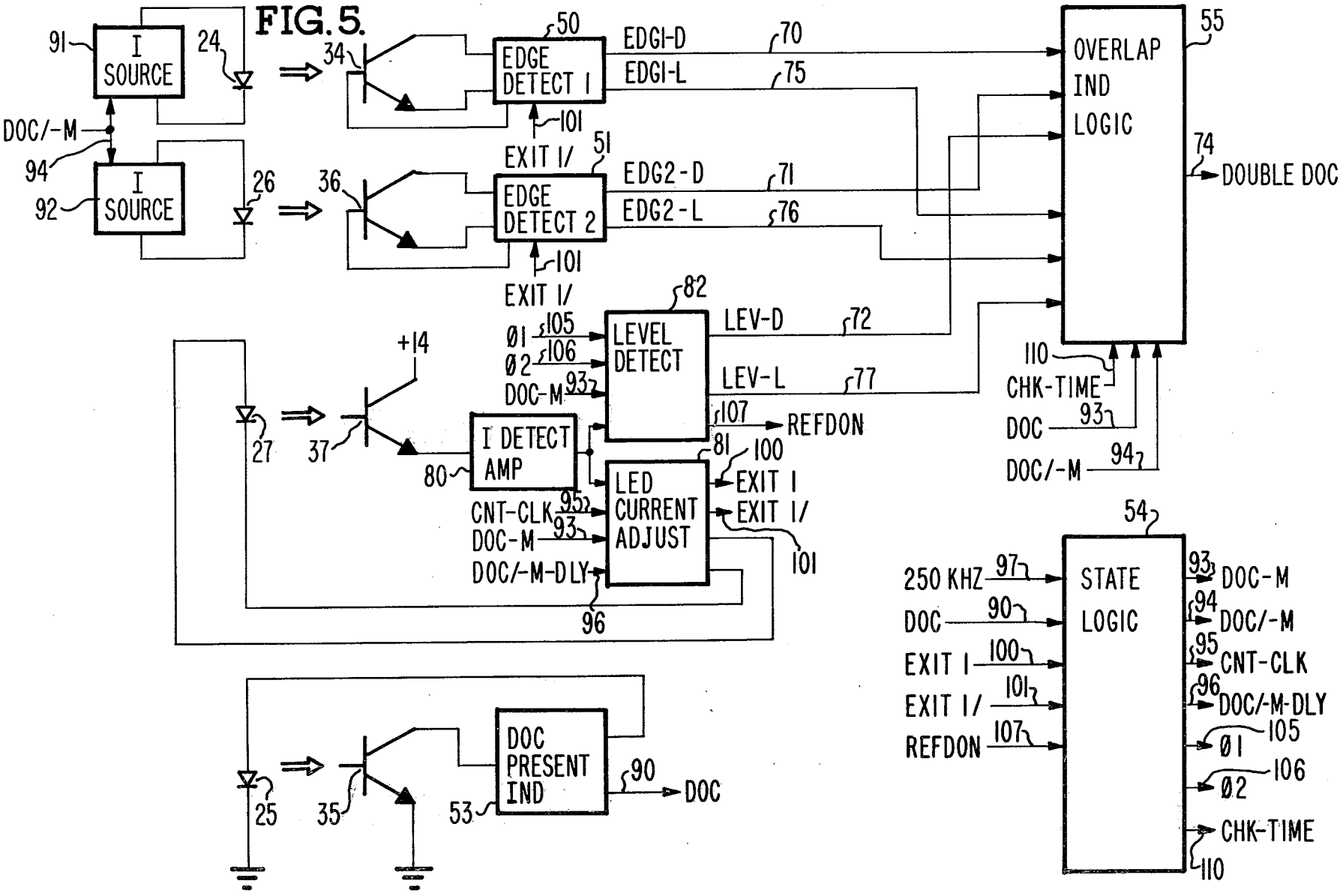
FIG. 5 is a general electrical block diagram for the apparatus shown in FIGS. 1, 2 and 3.
Figure 6:
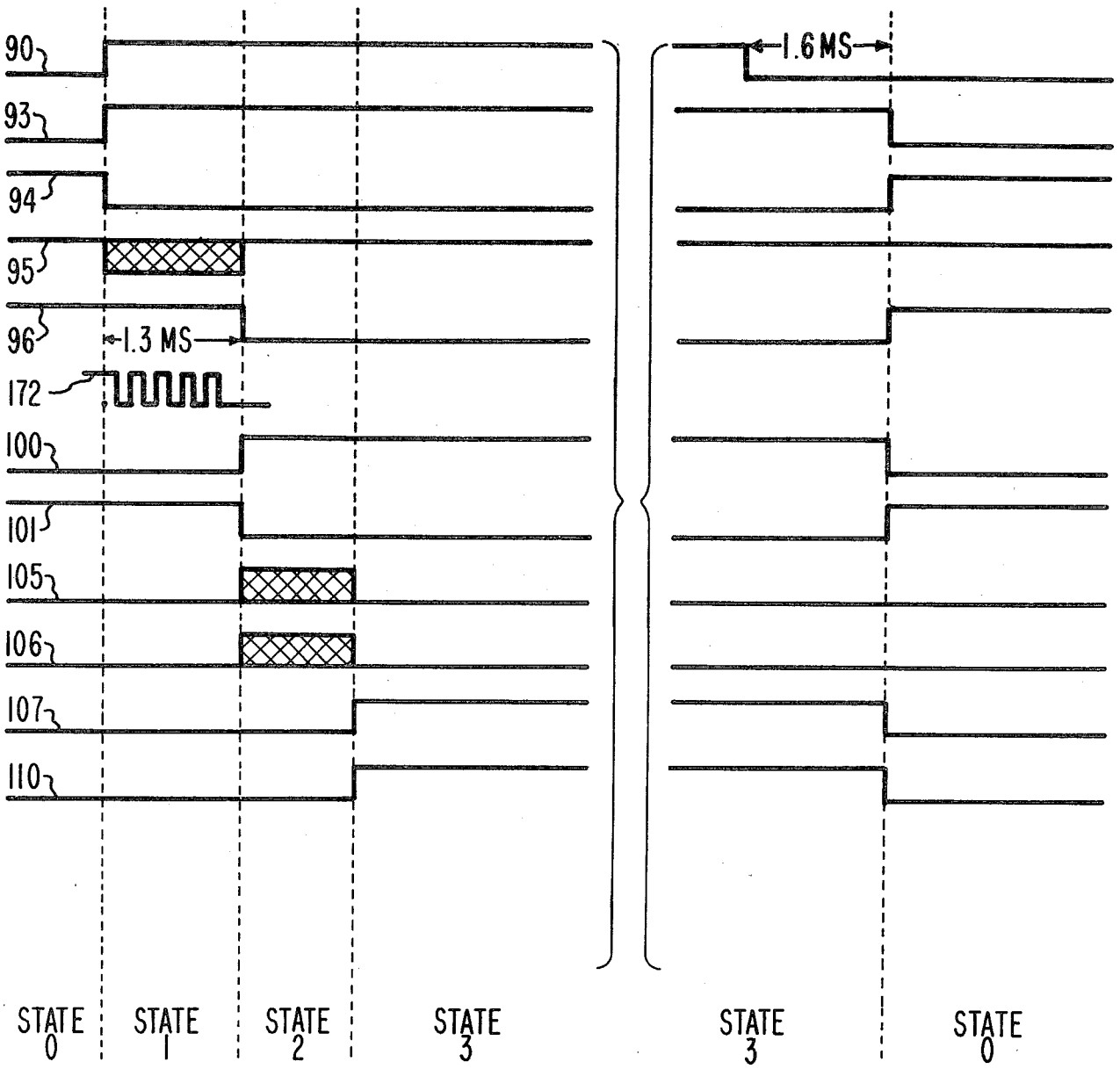
FIG. 6 is a timing diagram for the block diagram of FIG. 5.

Referring to FIGS. 5 and 6, FIG. 5 shows a complete electrical block diagram of the preferred embodiment, and the blocks 80, 81 and 82 of FIG. 5 correspond to the block 52 of FIG. 2. FIG. 6 shows a timing diagram for the block diagram of FIG. 5 with increasing time being from left to right.

State 0 exists when no document is present between the light source 25 and the light detector 35.

State 1 is entered when the document present indicator 53 indicates a document (DOC) on conductor 90. Briefly, during state 1, the current through the level detect light detector 37 is set to a predetermined operating range via the LED current adjust 81 because the level detect is DC coupled. Also during state 1, the current sources 91 and 92 for the edge detects are turned on. State 1 lasts for at least 1.3 milliseconds (which corresponds to 0.1 inch of document travel) but may be longer to await the completion of the current adjust.

More particularly with respect to State 1, when indicator 53 povides a DOC on conductor 90, the state logic 54 enters state 1 and provides a DOC-M signal on conductor 93, a DOC/-M signal on conductor 94, a CNTCLK signal on conductor 95 and a DOC/-M-DLY signal on conductor 96. The DOC-M signal on 93 is the same as the DOC signal on 90 except it has a 1.6 millisecond trailing edge delay before it will change state, this trailing edge delay provides hole ignoring protection should a hole less than 0.12 inch wide be encountered by detector 35 on a document. The DOC/-M signal on 94 is the inverse of the DOC-M signal on 93. During state 1, the logic 54 generates a CNTCLK which is a repetitive pulse train of four microsecond, logical 0 level, pulses at 64 microsecond intervals as derived from the 250 KHz clock 97. The DOC/-M-DLY signal on 96 provides a 1.3 millisecond delay after DOC on 90 appears and this corresponds to 0.1 inch of document travel.

During State 1, the current adjust 81 is adjusted to provide a current within a given desired range through the light detector 37. The current adjust 81 provides an EXIT 1 signal on conductor 100 after 1.3 milliseconds in state 1 or as soon thereafter as the current adjustment is complete. EXIT 1/ on conductor 101 is the inverse of EXIT 1.

At the beginning of state 1, the current sources 91 and 92 are turned on. They are turned off between documents to extend LED life. LEDs 24 and 26 are driven by 50 ma.

State 2 is entered when the EXIT 1 signal on 100 changes state. Briefly, in state 2, the level detect 82 samples and holds the output of the light detector 37 via the current detect amplifier 80. Also, at the beginning of state 2, the EXIT 1/ signal on 101 is input to the edge detects 50 and 51 to enable them.

More particularly with respect to state 2, when current adjust 81 provides EXIT 1 on conductor 100, state logic 54 enters state 2 and provides a $\phi 1$ signal on conductor 105 and a $\phi 2$ signal on conductor 106. $\phi 1$ and $\phi 2$ are mutually exclusive pulses two microseconds wide, are separated from each other by two microseconds and have a repetition period of eight microseconds.

During state 2, the level detect 82 samples and holds the translucency level out of light detector 37. When the sample and hold is complete, level detect 82 provides a REFDON signal on conductor 107. Normally, the state logic remains in state 2 for approximately 0.20 milliseconds which corresponds to another 0.015 inch of document travel.

At the beginning of state 2, the edge detects 50 and 51 are enabled by changing their time constants via conductor 101. The edge detects remain enabled through state 2 and state 3.

State 3 is entered when the REFDON signal on 107 changes state. Briefly, in state 3, the overlap indicating logic 55 is enabled, analyzes the outputs of the edge detects 50 and 51 and the level detect 52 as previously described with respect to FIG. 4, and indicates appropriate double (overlapped) documents on conductor 74. Normally, logic 55 is enabled after approximately 0.12 inch of document travel past the light detectors.

More particularly with respect to state 3, when level detect 82 provides REFDON on conductor 107, state logic 54 enters state 3 and provides check time (CHK-TIME) on conductor 110 to enable overlap indicating logic 55. State logic 54 remains in state 3 until DOC-M changes state indicating the end of a document.

During state 3, the overlap indicating logic monitors the outputs of level detect 82 on conductors 72 and 77. During state 3, the level detect 82 compares the present translucency level to the translucency level at the beginning of the document (in state 2) and indicates on either 72 or 77 when the present translucency level exceeds guardband levels on either side of the translucency level during state 2.

During state 3, the indicating logic also monitors the outputs of edge detects 50 and 51 on conductors 70, 75, 71 and 76. During state 3, the edge detects indicate when (and in what direction) the present translucency of the document has suddenly changed significantly from the translucency immediately prior to the sudden change in translucency.

The overlap indicating logic remains in state 3 checking for overlapped documents until DOC/-M changes state to indicate the end of the current document, at which time the logic 54 re-enters state O.

Figure 7:
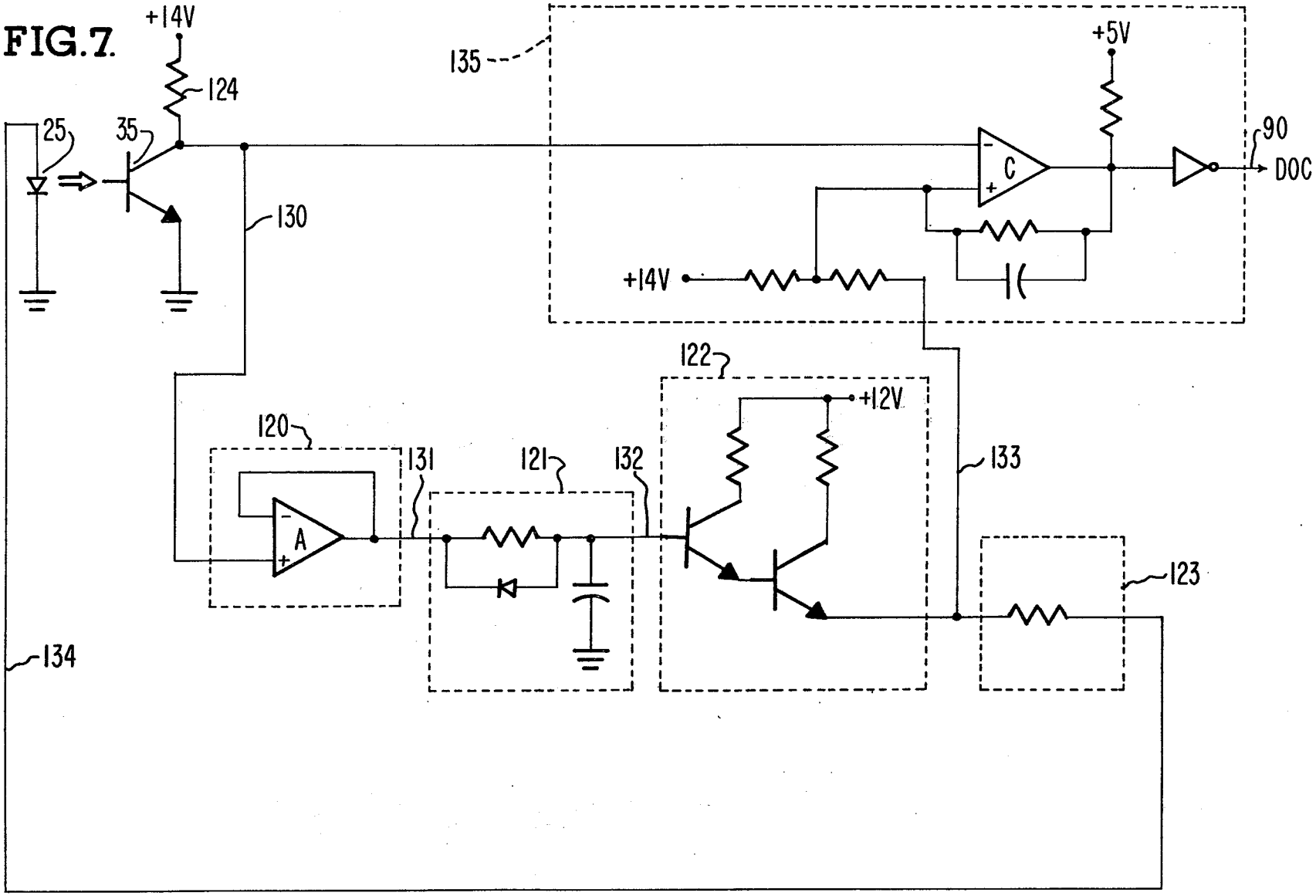
FIG. 7 shows example circuitry for the document present indicating block of FIG. 5.

FIG. 7 shows an example of circuitry that may be used for the document present indicator 53 in FIG. 5. The electronics provided by an amplifier 120, a one-way low pass filter 121, a darlington driver 122 and a current sense resistor 123 provide a closed loop around the LED 25 and the phototransistor 35. When no document is present between the LED and phototransistor, the current through the phototransistor and the resistor 124 is relatively large and provides approximately +5 to +7 volts on conductor 130. When a document is present between the LED 25 and the phototransistor 35, the voltage on conductor 130 goes up to approximately +14 volts. The unity gain buffer amplifier 120 provides the same voltage on conductor 131 as is present on conductor 130. Conductor 131 is input to low pass filter 121 which has a long, positive going voltage time constant and a short, negative going voltage time constant. Thus, the voltage on conductor 132 at the output of filter 121 goes down rapidly when the voltage on conductor 131 goes down; and the voltage on conductor 132 goes up slowly when the voltage on conductor 131 goes up. The voltage on conductor 132 is input to a darlington current amplifier 122 such that the voltage on conductor 133 tracks but is slightly lower (about 1.4 volts less) than the voltage on conductor 132. This voltage is fed to the LED 25 via the resistor 123 and the conductor 134. The purpose of the closed loop is to compensate for dirt in the track between the LED 25 and the phototransistor 35 when no document is present and to compensate for the aging of the LED and the phototransistor. Thus, with no document present, if the current through the the phototransistor is lower, the voltage on conductors 130, 131, 132 and 133 increases to provide more current through the LED 25 to raise the phototransistor current via the closed loop. When a document is present between the LED and the phototransistor, the long time constant of the filter 121 provides that the LED current increases very slowly. At the end of each document, the short time constant of the filter 121 provides that the LED current rapidly reverts to its closed loop, dirt and age compensating value. Thus, the closed loop provides long term dirt and aging compensation, but provides little change during the time a document is present. The comparator circuit 135 monitors the voltage on conductor 130 and is set to switch at approximately +8 volts. However, the voltage on conductor 133 is fed back to the comparator where a resistive divider adjusts the comparator threshold voltage. Thus, as the voltage on conductor 130 raises with no document present to compensate for dirt, the voltage on conductor 133 raises and the threshold of the comparator is also raised. The amplifier labeled A may be of the UA747 type powered by +14 vdc and −12 vdc; and the comparator labeled C may be of the CA339 type powered by +24 vdc and ground. The circuitry of FIG. 7 including the LED 25 and the phototransistor 35 provides a document present indicating means for enabling the edge detects and the level detect.

Figure 8:
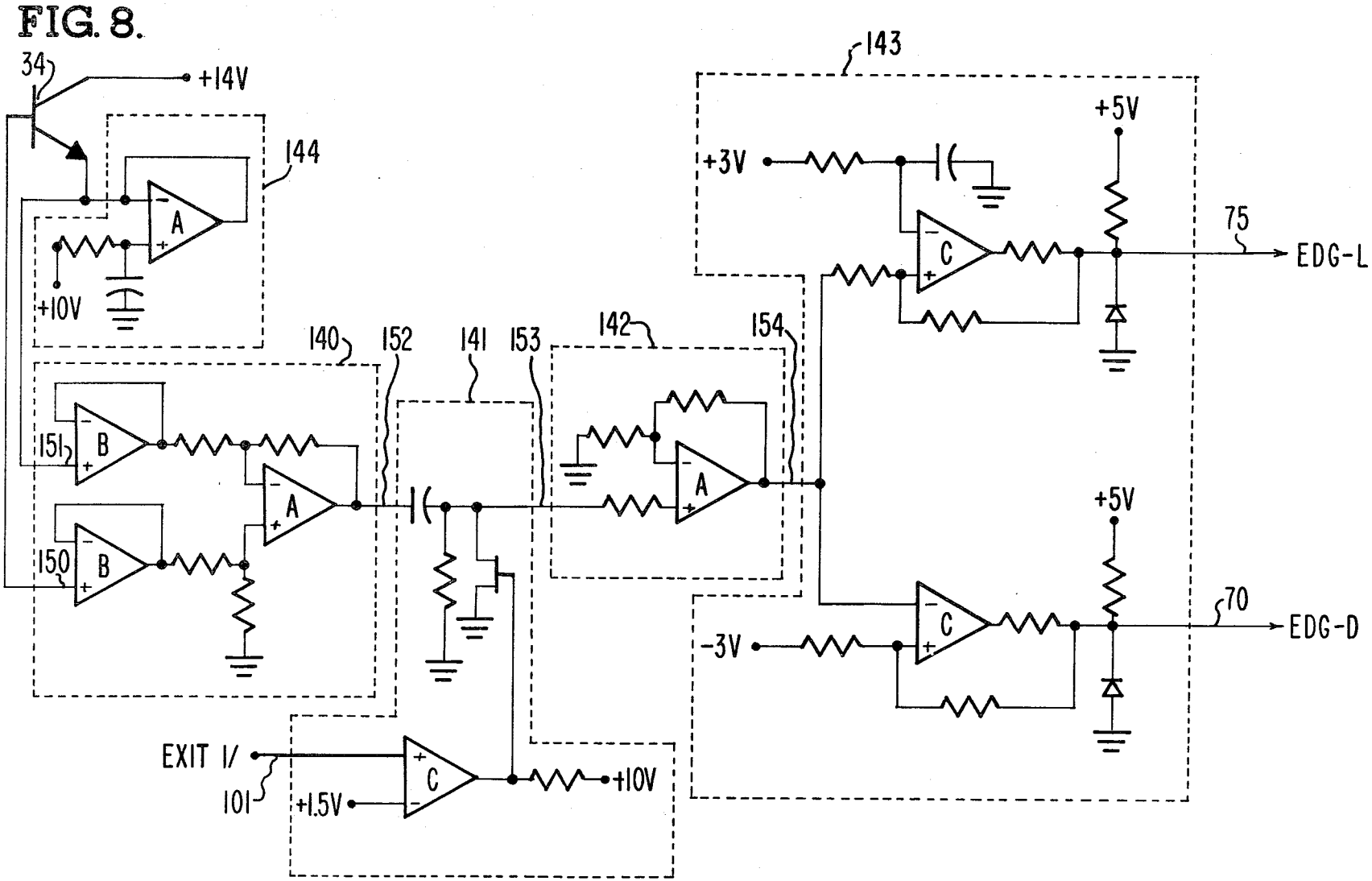
FIG. 8 shows example circuitry for the edge detect blocks of FIG. 5.

FIG. 8 shows an example of circuitry that may be used for the edge detects 50 and 51 in FIG. 5. The edge detect electronics comprises a differential amplifier 140, a high pass filter 141, an amplifier 142 and dual threshold detectors 143. A bias source 144 supplies four volts of bias between the collector and the emitter of phototransistor 34.

Phototransistor 34 has a logarithmic light input to electrical output transfer characteristic. Stated more particularly, the base-emitter voltage of the transistor is logarithmically related to the collector current of the phototransistor, which current is linearly related to the light intensity impinging on the phototransistor over some range. This logarithmic relationship permits the detector to be used over a wide range of light intensities and hence the detector can be used with documents having a wide range of translucenices. Thus, documents from tissue-like paper to cardboard-like material can be intermixed and used with the same edge detect without requiring readjustment of the edge detect LED current. The logarithmic relationship also provides a highly sensitive response regardless of the nominal translucency of a particular document. For example, because of the logarithmic relationship, a given percentage change in the light impinging on the phototransistor will provide the same magnitude of voltage change across the base-emitter junction of the transistor regardless of the initial magnitude of the light. Thus, the detector is sensitive over a broad range of light intensities and provides an output that is easily analyzable.

The output of detector 34 is input to the edge detect electronics via conductors 150 and 151. The detector 34 will, for example, provide voltage variations greater than eight millivolts due to translucency changes as the leading or trailing edge of an overlapped document passes thereby. The voltage between conductors 150 and 151 is input to differential amplifier 140. The conductor 150 should be kept short in length because it is at a high impedance location of the circuit. Circuit 140 provides a high input impedance noninverting buffer amplifier having a gain of 1 for each of the signals on conductors 150 and 151. The outputs of these buffer amplifiers are input to a differential amplifier which has a gain of 10 and provides an output on conductor 152 referenced to a monitor electronics ground.

The output of amplifier circuit 140 on conductor 152 may be input to an optional noise filter located in series between circuits 140 and 141. Such optional noise filter may be a first order, passive, RC, low pass filter having a time constant of 34 microseconds. This optional filter should eliminate any extraneous very high frequency signals such as those caused by static discharge due to the friction of the moving documents.

The output of the optional noise filter is input to high pass filter 141. Filter 141 may be provided by a first order, passive, RC, high pass filter having a time constant of 6.3 milliseconds. This filter blocks the DC (low frequency) component of the output of detector 34 to provide a signal representative of sudden changes in the output of the detector 34. The time constant of this filter can be switched to be approximately 10 microseconds by the EXIT 1/ signal on conductor 101. Thus, while no document is present or for approximately the first 1.3 milliseconds a document is present, the filter has the shorter time constant and the capacitor in the filter rapidly charges to the signal level at its input. After a document is present for approximately 1.3 milliseconds thus assuring that the documents will fully come between the edge detect LEDs and the edge detect phototransistors, then the RC filter is switched to the 6.3 millisecond time constant. In this latter state, the filter still differentiates the signal on conductor 152, but the longer time constant widens the signal waveform out of the filter. Thus, the filter 141 blocks the DC component of the output of the detector 34 and differentiates its input with a first order, passive, RC, high pass filter having a time constant of 6.3 milliseconds. Thus, a sudden change of eight millivolts in the output of the detector 34 will provide an appropriate plus or minus 80 millivolt output from the filter 141 on conductor 153. It should also be noted that this 6.3 millisecond time constant is also related to the immediately previous translucency referred to with respect to the edge detects in the preferred embodiment, because this time constant represents the recovery time constant of the base line from which the sudden changes are detected.

The output of high pass filter 141 on conductor 153 is input to a differential amplifier having a gain of 38. Thus, a sudden change of eight millivolts in the output of detector 34 will provide an appropriate plus or minus 3 volt output from the amplifier 142 on conductor 154.

The output of amplifier 142 on conductor 154 is input to threshold detector 143 which has two comparators (threshold detectors). One comparator triggers at +3 volts on conductor 154 to provide an EDG-L signal on conductor 75 for as long as the signal on conductor 154 is greater than +3 volts. The other comparator triggers at −3 volts on conductor 154 to provide an EDG-D signal on conductor 70 for as long as the signal on conductor 154 is less than −3 volts. Thus, a sudden, significant increase in document translucency will provide an EDG-L (edge light) signal on 75 and a sudden significant decrease in document translucency will provide an EDG-D (edge dark) signal on 70.

In FIG. 8, the amplifiers labeled A may be of the UA747 type; the amplifiers labeled B may be of the TL084 type; and the comparators may be of the CA339 type. The amplifiers and comparators may be powered by +14 vdc and −12 vdc.

The high pass filter 141 provides a means for detecting rapid changes in the output of its light detector in the preferred embodiment. The threshold detector 143 in turn provides a comparator means for indicating when the rapid changes exceed a predetermined value in the preferred embodiment. And, in the preferred embodiment, the high pass filter 141, the threshold detector 143, and the amplifiers 140 and 142 together provide edge detect monitor electronics, which monitor electronics together with a light source and a light detector provides a means for indicating that the present translucency has suddenly changed significantly from the immediately previous translucency in the preferred embodiment.

Figure 9:
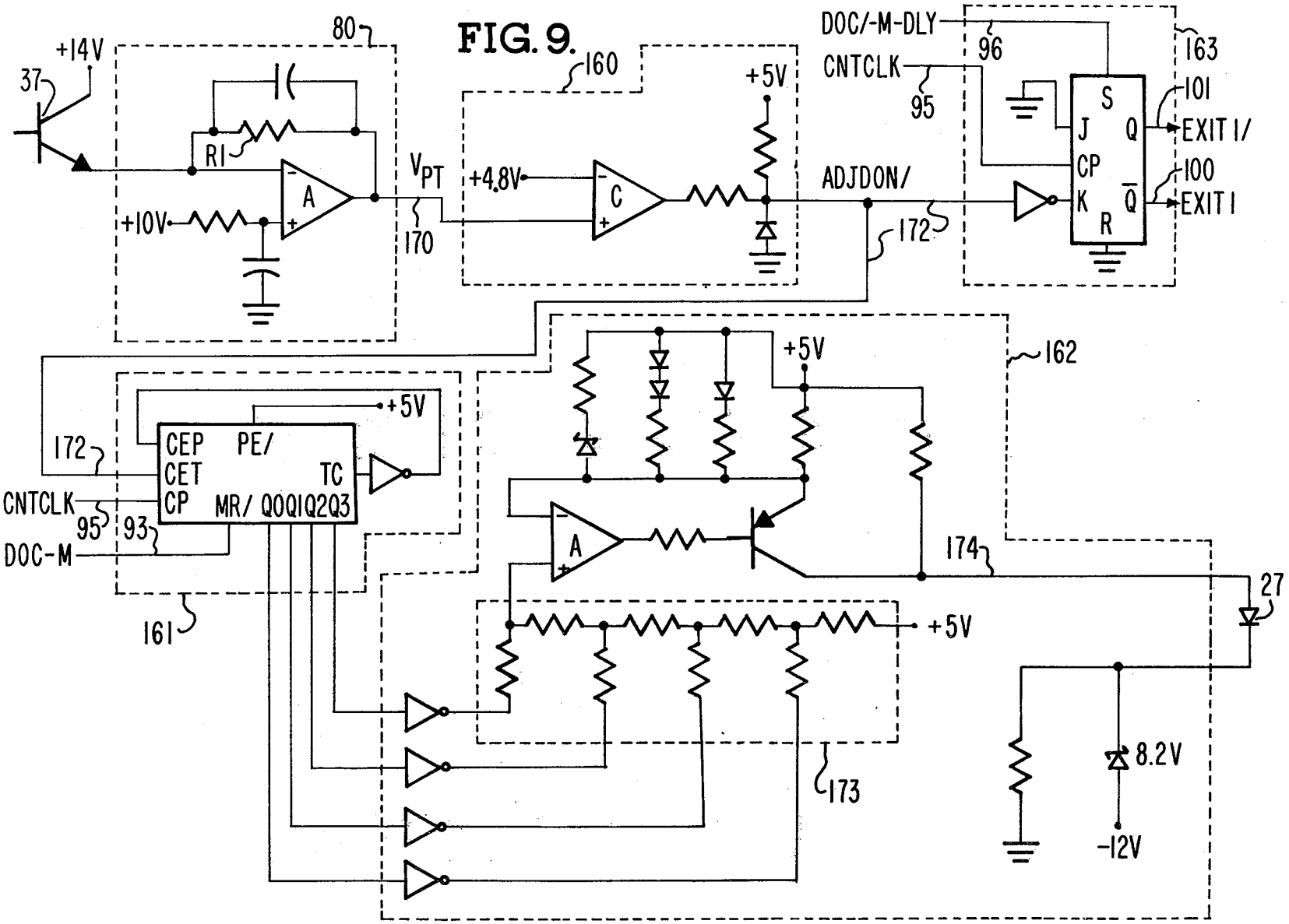
FIG. 9 shows example circuitry for the LED current adjust block of FIG. 5.

FIG. 9 shows an example of circuitry that may be used for the current detect amplifier 80 and the LED current adjust 81 in FIG. 5. As previously described, during state 1, the current adjust 81 increases the current in the LED 27 until the current through the level detect phototransistor 37 is within a desired range. Such current adjustment is desirable because the level detect by its very nature is DC coupled and the level detect must work with documents of various thicknesses and translucencies. (In contrast, the current through the edge detect LEDs 24 and 26 is a fixed value because the edge detects are AC coupled.) Current adjust 81 includes a comparator 160, a counter 161, a nonlinear digital to current converter 162 and an exit state 1 flip-flop 163. The blocks 80, 160, 161 and 162 form a closed loop around the level detect LED 27 and the level detect phototransistor 37. The closed loop adjusts the current through the LED until the $V_{pt}$ voltage on conductor 170 is less than +4.8 volts.

The current detect amplifier 80 monitors the current through phototransistor 37 by in effect measuring the voltage drop across the amplifier's feedback resistor R1. Thus, the difference between $V_{pt}$ and +10 volts divided by resistor R1 is the current through the phototransistor.

The output of current detect 80 on conductor 170 is input to comparator 160. Comparator 160 compares $V_{pt}$ to +4.8 volts and provides a logical 1 level ADJDON/ (adjust done not) signal on conductor 172 whenever $V_{pt}$ is more than 4.8 volts.

This adjust done not signal on conductor 172 is input to counter 161 to enable and disable its counting function. Counter 161 may be a 4 bit binary counter that is reset to zero by DOC-M between documents. At the beginning of state 1, DOC-M releases the counter and thereafter during state 1 the counter counts CNTCLK pulses on conductor 95 under the enable/disable control of ADJDON/ on conductor 172.

The outputs of counter 161 are input to nonlinear digital to current converter 162. Converter 162 contains a linear R-2R voltage ladder network 173 that provides a digital to analog conversion. The output of the ladder 173 is input to an operational amplifier type current source that has nonlinear gain as provided by a network of diodes and resistors in the transistor's emitter path. The function of the nonlinear gain is to increase the output of the phototransistor 37 as rapidly as possible while still keeping $V_{pt}$ within a desired range so as to minimize the time to complete the current adjustment. The operational amplifier type current source could have linear gain, but then it would take more steps (longer) to get the current in the phototransistor up to the desired level. The current output of the digital to current converter on conductor 174 is input to LED 27 to close the loop.

In operation, at the beginning of state 1, counter 161 is reset to zero and there is negligible current through LED 27. Thereafter, during state 1, counter 161 counts clock pulses on conductor 95 to increase the LED current and hence increase the phototransistor current and decrease $V_{pt}$. When $V_{pt}$ becomes less than +4.8 volts, comparator 160 disables counter 161 via conductor 172. It should be noted that the comparator 160 may disable and re-enable the counter 161 several times during state 1 (see FIG. 6) as the document more fully comes between the LED 27 and the phototransistor 37. The flip-flop 163 remains set by the DOC/-M-DLY signal on conductor 95 for the first 1.3 milliseconds of state 1. Thereafter, the flip-flop is released and the next ADJDON/ signal on conductor 172 will reset the flip-flop to generate the EXIT 1 (exit state 1) signal on conductor 100. In response to the EXIT 1 signal, state logic 54 will stop generating CNTCLK pulses on conductor 95 such that blocks 161 and 162 provide the same current to the level detect LED 27 for the remainder of the document (until reset by DOC-M on conductor 93).

In FIG. 9, the amplifiers labeled A may be of the UA747 type and the comparator labeled C may be of the CA339 type. The amplifiers and comparators may be powered by +14 vdc and −12 vdc.

Figure 10:
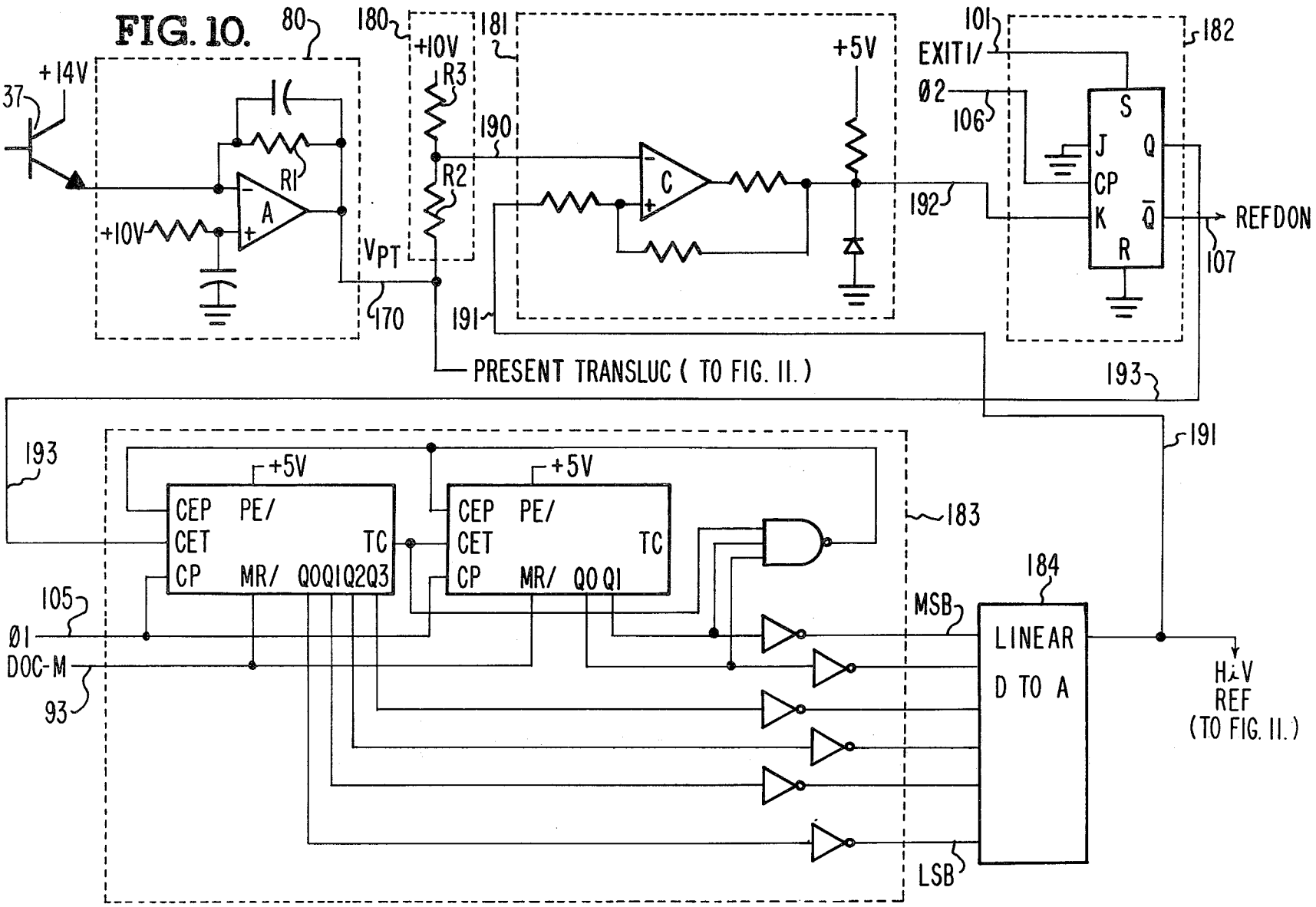
FIGS. 10 and 11 show example circuitry for the level detect block of FIG. 5.
Figure 11:
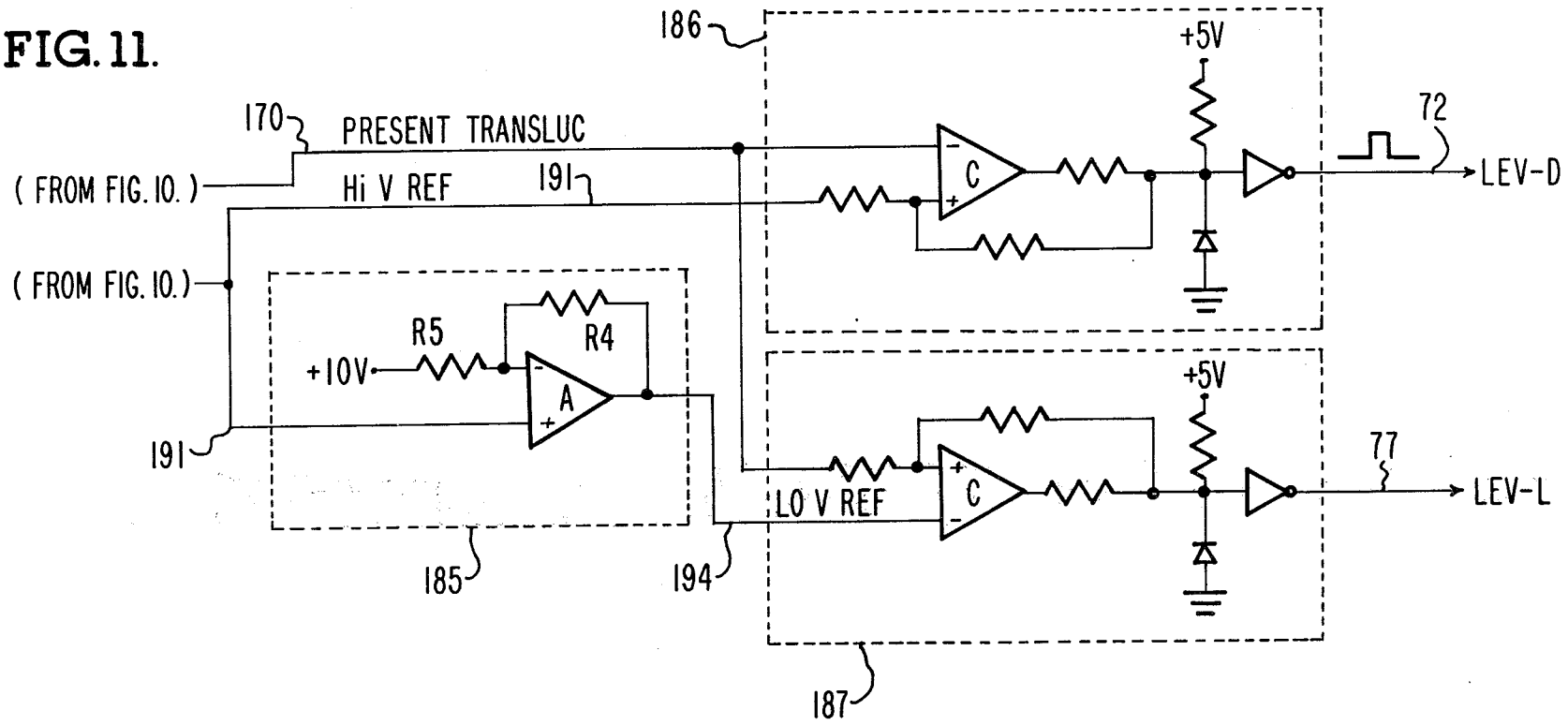

FIGS. 10 and 11 show an example of circuitry that may be used for the current detect amplifier 80 and the level detect 82 in FIG. 5. As previously described, during state 2, the level detect 82 samples and holds the translucency level at the beginning of the document. Thereafter, during state 3, the level detect 82 indicates when the present translucency level of the document differs from the translucency level at the beginning of that document by a given amount. Level detect 82 comprises a high voltage level shifter 180, a comparator 181, a flip-flop 182, a counter 183, a linear D to A 184, a low voltage level shifter 185, a high voltage comparator 186 and a low voltage comparator 187.

The current detect amplifier 80 monitors the current through the phototransistor 37 and is the same current detect amplifier that was previously described with respect to FIG. 9.

The $V_{pt}$ output of the current detect amplifier on conductor 170 represents the present translucency of the document and is input to high voltage level shifter 180. High voltage level shifter 180 is formed by a resistive divider that places a voltage on conductor 190 that represents a 35% decrease in translucency.

Comparator 181 compares the voltage on conductor 190 to the voltage on conductor 191 from the linear D to A 184. Comparator 181 together with flip-flop 182, counter 183 and D to A 184 forms a closed loop digital sample and hold that stores an analog voltage level on conductor 191 that represents the translucency value on conductor 170 during state 2.

The output of comparator 181 on conductor 192 is input to flip-flop 182. Flip-flop 182 is set by EXIT 1/ on conductor 101 during state 0 and state 1. At the beginning of state 2, EXIT 1/ releases the flip-flop 182. Thereafter, during state 2, at each $\phi 2$ clock pulse, flip-flop 182 checks comparator 181 to determine if the sample and hold is complete. When the sample and hold is complete, REFDON on conductor 107 changes from a logical 0 to a logical 1 and state logic 54 enters state 3.

The output of flip-flop 182 on conductor 193 is used to enable the counter 193. DOC-M resets the counter 193 to zero between documents. During state 2, counter 193 counts $\phi 1$ clock pulses on conductor 105 while the counter is enabled by the signal on conductor 193. Counter 193 may be an eight bit binary up counter. When the signal on conductor 193 disables the counter 183 the counter remains at its present count until reset by DOC-M at the end of the document.

The outputs of the counter 193 are input to linear D to A 184 which converts the counter output to an analog voltage for comparison by the comparator 181.

Thus, via the closed loop provided by blocks 181, 182, 183 and 184, the voltage on conductor 191 is increased a step at a time until it approximates the voltage on conductor 190, at which time the sample and hold is complete. The voltage on conductor 191 represents approximately a 35% decrease in translucency from the translucency represented by $V_{pt}$ during state 2. The voltage on conductor 191 remains until the counter 183 is cleared to zero at the end of the document.

Referring to FIG. 11, the high voltage reference (35% decrease in translucency) on conductor 191 is input to low voltage level shifter 185. Level shifter 185 provides a voltage on conductor 194 that represents approximately a 35% increase in translucency from the translucency represented by $V_{pt}$ during state 2. The voltage on conductor 194 also remains until the counter 183 is cleared to zero at the end of the document.

The manner in which the ±35% translucency levels are generated is based upon the fact that blocks 80, 180 and 185 are all referenced to +10 volts. With this in mind, ±35% translucency references can be provided by the following choice of resistors for blocks 80, 180 and 185:

R1=220K
R2=34K
R3=61.9K
R4=10.2K
R5=9.53K

At the completion of state 2, the high voltage reference on conductor 191 (35% decrease in translucency) and the low voltage reference on conductor 194 (35% increase in translucency) are frozen for the remainder of the document (state 3). During state 3, high voltage comparator 186 compares the present translucency level on conductor 170 to the high voltage reference on conductor 191 and indicates a level dark (LEV-D) with a logic 1 level on conductor 72 whenever the present translucency level is less than the 35% decrease in translucency level. During state 3, low voltage comparator 187 compares the present translucency level on conductor 170 to the low voltage reference on conductor 194 and indicates a level light (LEV-L) with a logic 1 level on conductor 77 whenever the present translucency level is more than the 35% increase in translucency level. Thus, the comparators 186 and 187 compare the present translucency level of the document to guardband translucency levels and indicate when and in what direction the guardbands are exceeded.

In FIGS. 10 and 11, the amplifiers labeled A may be of the UA747 type and the comparators may be of the CA339 type. The amplifiers and comparators may be powered by +14 vdc and −12 vdc.

The sample and hold circuit provided by blocks 180, 181, 182, 183 and 184 provides a means for storing the translucency level at the beginning of each document in the preferred embodiment. Alternatively, the means for storing the translucency at the beginning of each document could be provided by an analog sample and hold circuit. The comparators 186 and 187 provide a comparator means which together with the blocks 180, 185, 181, 182, 183, and 184 provides a means for indicating when the present translucency level differs by at least a given amount from the translucency level at the beginning of each document in the preferred embodiment. And, blocks 80, and 180 through 187 provide the level detect monitor electronics of the preferred embodiment; and such monitor electronics together with light source 27 and light detector 37 provide the level detecting means of the preferred embodiment.

Figure 12:
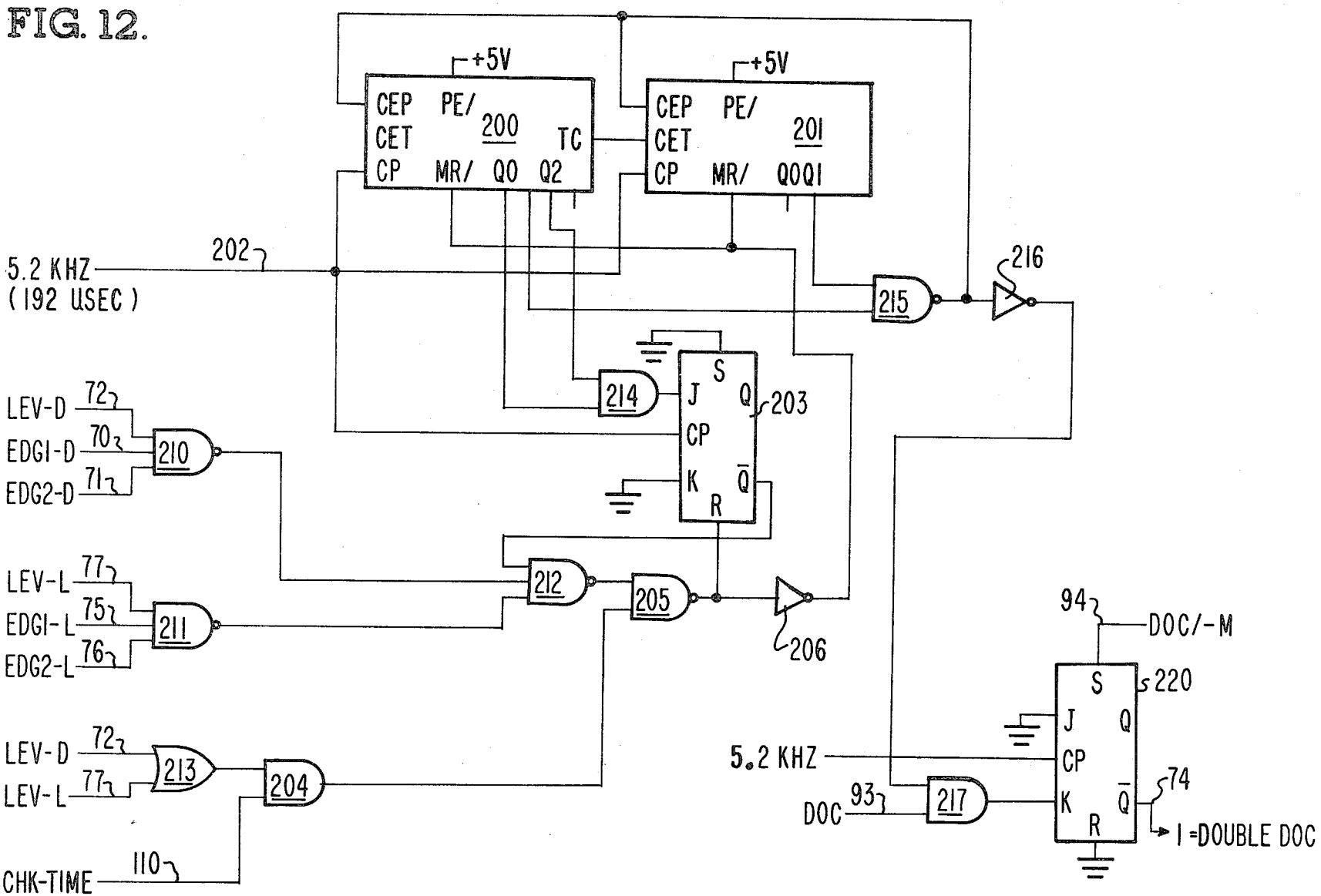
FIG. 12 shows example circuitry for the overlap indicating logic block of FIG. 5.

FIG. 12 shows an example of circuitry that may be used for the overlap indicating logic 55 in FIG. 5. As previously described with respect to FIG. 4, during state 3, the overlap indicating logic 55 first requires all three signals of the same polarity (either two EDG-D signals and LEV-D, or two EDG-L signals and LEV-L) to be coincident for one millisecond. Then, the overlap indicating logic 55 requires the appropriate level signal (LEV-D or LEV-L) to be continuously present for an additional 5.6 milliseconds. When both requirements have been met, the logic 55 then indicates a double (overlapped) document on conductor 74.

Counters 200 and 201 together provide a clearable (resettable to zero) 8 bit binary timing counter that counts the 5.2 KHz clock signal on conductor 202. Flip-flop 203 provides the one millisecond timing control.

During state 0, 1 and 2; the indicator logic 55 is inactive. As previously described, CHK-TIME on conductor 110 is a logical 1 only during state 3. Thus, during states 0, 1, and 2; AND gate 204 provides a logical 0 output, NAND gate 205 provides a logical 1 output to hold the flip-flop 203 reset, and INVERTER gate 206 provides a logical 0 to hold the 8 bit counter reset to a count of zero.

When state 3 is entered, CHK-TIME on conductor 110 becomes a logical 1 and the overlap indicating logic is enabled to perform its function.

As previously described, the overlap indicating logic 55 first requires all three dark or all three light signals to be coincident for one millisecond during state 3. When all three signals are coincident; either NAND gate 210 or NAND gate 211 provides a logical 0 such that NAND gate 212 provides a logical 1 into gate 205. Likewise, OR gate 213 provides a logical 1 such that gate 204 provides a logical 1 to gate 205. Thus, with all three signals of one polarity coincident, gate 205 provides a logical 0 to enable flip-flop 203 and gate 206 provides a logical 0 to enable flip-flop 203 and gate 206 provides a logical 1 to enable the 8 bit binary counter (200 and 201). If any one of the three coincident signals should disappear during the first millisecond of coincidence, the flip-flop 203 and counter would be reset. Assuming all three signals of the same polarity (dark or light) are coincident for the one millisecond, the counter will count five clock cycles at which time AND gate 214 will provide a logical 1 to the J input of flip-flop 203. One-half clock cycle later, the flip-flop 203 will set. When the flip-flop 203 sets, it provides a logical 0 to gate 212 such that coincidence of all three signals via either gate 210 or gate 211 is no longer necessary. Thus, all three signals of one polarity must be present for approximately 5½ clock cycles which is approximately one millisecond. This one millisecond corresponds to approximately 0.075 inch of document travel.

As previously described, the overlap indicating logic then requires the appropriate level signal to remain for another 5.6 milliseconds for a total time of 6.6 milliseconds. With flip-flop 203 now set, gate 212 provides a logical 1 to gate 205. Likewise, the presence of the level signal into gate 213 and CHK-TIME into gate 204 provides a logical 1 into the other input to gate 205 such that the flip-flop 203 and the counter remain enabled as long as the level is continuously input into gate 213. Thus, the counter continues to count. When the counter reaches a total count of 34 (2+32); NAND gate 215 stops the counter at the 34 count and INVERTER gate 216 provides a logical 1 level to AND gate 217. If the document is still present (DOC on conductor 93), one-half clock cycle later the flip-flop 220 will be reset to indicate an overlapped document. At the completion of state 3, the flip-flop 220 is set via DOC/-M on conductor 94. Thus, the level signal must be continuously present for approximately 34½ clock cycles which is approximately 6.6 milliseconds. This time corresponds to approximately one-half inch of document travel at 75 inches per second.

The one millisecond coincidence required by the logic corresponds to a first predetermined time; and the continuous existence of the level for 6.6 milliseconds corresponds to a second predetermined time. And, the logic of FIG. 12 as a whole provides the overlap indicating means of the preferred embodiment.

The state logic 54 of FIG. 5 receives the input signals that have been previously described with respect to FIG. 4. In response to these input signals and the 250 KHz time base on conductor 97, the state logic may utilize standard counters, flip flops and gates to synchronously provide its output signals as previously described with respect to FIG. 4.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

What is claimed is:

1. An apparatus for detecting overlapped documents in a system that moves documents, said apparatus comprising:

(a) a first edge detecting means for monitoring document translucency and for indicating that the present translucency of the document has suddenly changed significantly from the immediately previous translucency of the same document;

(b) level detecting means for monitoring document translucency and for indicating when the present translucency level of the document differs by at least a given amount from the translucency level prior to the sudden change in translucency;

(c) means responsive to said edge detecting means and said level detecting means for indicating overlapped documents, said overlap indicating means requiring (1) coincidence between the output indications of said edge detecting means and said level detecting means; and (2) the output indication of said level detecting means to exist for a given time.

2. The apparatus according to claim 1 wherein:

the coincidence required by said overlap indicating means must be present for at least a first predetermined time; and the existence of the output indication of said level detecting means must be continuously present for at least a second predetermined time, and said second predetermined time is greater than said first predetermined time.

3. The apparatus according to claim 2 wherein:

said first predetermined time corresponds to the time that the document normally moves approximately 0.1 inch; and said second predetermined time corresponds to the time that the document normally moves approximately 0.5 inch.

4. The apparatus according to claim 1 wherein said level detecting means indicates when the present translucency level of the document differs by at least a given amount from the translucency level at a beginning portion of the same document.

5. The apparatus according to claim 4 wherein said level detecting means further comprises:

means for storing the translucency level at the beginning of each document; and means for indicating when the present translucency level differs from the translucency level at the beginning of each document by a given amount.

6. The apparatus according to claim 5 wherein the given amount is a predetermined proportion of the stored translucency value.

7. The apparatus according to claim 1 wherein:

said apparatus further comprises a second edge detecting means for monitoring document translucency and for indicating that the present translucency of the document has suddenly changed significantly from the immediately previous translucency of the same document; and said overlap indicating means in paragraph c1 of claim 1 requires coincidence between said first edge detecting means, said second edge detecting means and said level detecting means.

8. The apparatus according to claim 1 wherein: said first edge detecting means comprises:

(1) light source means located one one side of the moving document;

(2) light detector means located on the other side of the moving document; and (3) monitor electronics connected to the light detector means for indicating that the present translucency of the document has suddenly changed significantly from the immediately previous translucency of the same document; and said level detecting means comprises:

(1) light source means located on one side of the moving document;

(2) light detector means located on the other side of the moving document; and (3) monitor electronics connected to the light detector means for indicating when the present translucency level of the document differs from the translucency level prior to the sudden change by at least a given amount.

9. An apparatus for moving documents and detecting overlapped documents therein, said apparatus comprising:

(a) a document transport path;

(b) means for moving documents along said transport path;

(c) a first edge detecting means for indicating sudden changes in document translucency along the length of the same document, said first edge detecting means comprising:

(1) light source means located along one side of the document transport path for illuminating a first portion of the document;

(2) a first light detector means located along the other side of the transport path for detecting light passing through said first portion of the document; and (3) monitor electronics connected to said first light detector means for indicating that the present translucency of the document has suddenly changed significantly from the immediately previous translucency of the same document;

(d) a level detecting means for indicating when the present translucency level of the document differs by at least a given amount from the translucency level of a portion of the same document prior to said sudden change in translucency, said level detecting means comprising:

(1) light source means located along one side of the document transport path for illuminating a second portion of the document;

(2) a second light detector means located along the other side of the transport path for detecting light passing through said second portion of the document; and (3) monitor electronics connected to said second light detector means for indicating when the present translucency level of the document differs from the translucency level prior to the sudden change by at least a given amount; and (e) document overlap indicating means responsive to said edge detecting means and said level detecting means for indicating overlapped documents, said overlap indicating means requiring (1) coincidence between the output indications of said edge detecting means and said level detecting means for at least a first predetermined time; and (2) the output indication of said level detecting means must be continuously present for at least a second predetermined time, wherein said second predetermined time is greater than said first predetermined time.

10. The apparatus according to claim 9 wherein said level detecting means indicates when the present translucency level of the document differs by at least a given amount from the translucency level at a beginning portion of the same document.

11. The apparatus according to claim 10 wherein said level detecting means further comprises:

means for storing the translucency level at the beginning of each document; and means for indicating when the present translucency level differs from the translucency level at the beginning of each document by at least a given amount.

12. The apparatus according to claim 11 wherein:

said means for storing the translucency level at the beginning of each document comprises sample and hold means; and said means for indicating when the present translucency level differs from the translucency level at the beginning of each document comprises comparator means.

13. The apparatus according to claim 11 wherein the given amount is a predetermined proportion of the stored translucency value.

14. The apparatus according to claim 9 wherein the monitor electronics of said first edge detecting means comprises:

means for detecting rapid changes in the output of said first light detector means; and comparator means responsive to said rapid change detecting means for indicating when the rapid changes exceed a predetermined value.

15. The apparatus according to claim 14 wherein:

said rapid change detecting means comprises a high pass filter; and said comparator means comprises a comparator circuit.

16. The apparatus according to claim 9 wherein:

said apparatus further comprises a second edge detecting means for indicating sudden changes in document translucency along the length of the same document, said second edge detecting means comprising:

(1) light source means located along one side of the document transport path for illuminating a third portion of the document;

(2) a third light detector means located along the other side of the transport path for detecting light passing through said third portion of the document; and (3) monitor electronics connected to said third light detector means for indicating that the present translucency of the document has suddenly changed significantly from the immediately previous translucency of the same document; and said document overlap indicating means in paragraph e1 of claim 9 requires coincidence between said first edge detecting means, said second edge detecting means and said level detecting means for at least said first predetermined time.

17. The apparatus according to claim 16 wherein:

the monitor electronics of said first edge detecting means comprises:

means for detecting rapid changes in the output of the first light detector means; and comparator means responsive to said rapid change indicating means for indicating when the rapid changes exceed a predetermined value; and the monitor electronics of said second edge detecting means comprises:

means for detecting rapid changes in the output of the third light detector means; and comparator means responsive to said rapid change indicating means for indicating when the rapid changes exceed a predetermined value.

18. The apparatus according to claim 17 wherein said level detecting means indicates when the present translucency level of the document differs by at least a given amount from the translucency level at a beginning portion of the same document.

19. The apparatus according to claim 9 further including document present indicating means for enabling said level detecting means.

20. A process for moving documents and detecting when documents are overlapped, comprising:

(a) providing a transport path for guiding the documents;

(b) moving documents along the transport path;

(c) indicating when the present translucency of a first portion of one of the documents has suddenly changed significantly from the immediately previous translucency of the same document;

(d) indicating when the present translucency level of a second portion of the same document differs by at least a given amount from the translucency level prior to the sudden change in translucency; and (e) indicating overlapped documents when (1) there is coincidence between the output indications of steps c and d; and (2) the output indication of step d continuously exists for a given time.

21. A process for moving documents and detecting when documents are overlapped, comprising:

(a) providing a transport path for guiding the documents;

(b) moving documents along the transport path;

(c) indicating when the present translucency of a first portion of one of the documents has suddenly changed significantly from the immediately previous translucency of the same document;

(d) indicating when the present translucency level of a second portion of the same document differs by at least a given amount from the translucency level prior to the sudden change in translucency;

(e) indicating when the present translucency of a third portion of the same document has suddenly changed significantly from the immediately previous translucency of the same document; and (f) indicating overlapped documents when (1) there is coincidence between the output indications of steps c, d and e; and (2) the output indication of step d continuously exists for a given time.

* * * * *